US008556391B2

(12) United States Patent
Koseki

(10) Patent No.: US 8,556,391 B2
(45) **Date of Patent: *Oct. 15, 2013**

(54) LIQUID JET HEAD, LIQUID EJECTION APPARATUS, AND MANUFACTURING METHOD FOR THE LIQUID JET HEAD

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 253 days.

This patent is subject to a terminal disclaimer.

(21) Appl. No.: 12/925,687

(22) Filed: Oct. 27, 2010

(65) Prior Publication Data

US 2011/0102519 A1 May 5, 2011

(30) Foreign Application Priority Data

Oct. 29, 2009 (JP) ..... 2009-249099

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

| | | | | |
|---|---|---|---|---|
| 6,336,715 | B1 * | 1/2002 | Hotomi et al. | 347/68 |
| 6,820,966 | B1 | 11/2004 | Drury et al. | 347/57 |
| 7,097,287 | B2 * | 8/2006 | Nakao et al. | 347/85 |
| 7,937,835 | B2 * | 5/2011 | Anderson et al. | 29/890.1 |

* cited by examiner

*Primary Examiner* — Matthew Luu
*Assistant Examiner* — Erica Lin
(74) *Attorney, Agent, or Firm* — Adams & Wilks

(57) ABSTRACT

A liquid jet apparatus includes a nozzle plate having at least one nozzle for ejecting a liquid onto a recording medium, a cover plate having a liquid supply hole for supplying the liquid and a liquid discharge hole for discharging the liquid, and a piezoelectric plate having at least one elongated groove. The piezoelectric plate, cover plate and nozzle plate are stacked relative one another with the at least one elongated groove communicating with the at least one nozzle of the nozzle plate and with each of the liquid supply hole and the liquid discharge hole of the cover plate so that liquid supplied into the at least one elongated groove through the liquid supply hole circulates through the at least one elongated groove and is discharged from the liquid discharge hole.

20 Claims, 9 Drawing Sheets

LIQUID JET HEAD, LIQUID EJECTION APPARATUS, AND MANUFACTURING METHOD FOR THE LIQUID JET HEAD

BACKGROUND OF THE INVENTION

1. Field of the Invention

The present invention relates to a liquid jet head for ejecting a liquid from a nozzle to form images, characters, or a thin film material onto a recording medium. The present invention relates also to a liquid jet apparatus using the liquid jet head, and to a manufacturing method for the liquid jet head.

2. Description of the Related Art

In recent years, there has been used an ink-jet type liquid jet head for ejecting ink drops on recording paper or the like to draw and record characters or figures thereon, or for ejecting a liquid material on a surface of an element substrate to form a functional thin film thereon. Further, there has been used a liquid jet apparatus using the above-mentioned ink-jet type liquid jet head. In the ink-jet type liquid jet head, the ink or the liquid material is supplied from a liquid tank through a supply pipe into the liquid jet head, and then the ink is ejected from the nozzle of the liquid jet head to record the characters or the figures, or the liquid material is ejected to form the functional thin film having a predetermined shape.

FIG. 9 is a schematic sectional view of an ink-jet head 100 of the above-mentioned type described in Japanese Patent Translation Publication No. 2000-512233. The ink-jet head 100 has a three-layer structure of a cover 125, a PZT sheet 103 formed of a piezoelectric body, and a bottom cover 137. The cover 125 includes nozzles 127 for discharging small drops of ink. In an upper surface of the PZT sheet 103, there are formed ink channels 107 formed of an elongated groove having a cross-section having a convex shape toward a bottom thereof. The plurality of ink channels 107 are formed so as to be parallel to each other in a direction orthogonal to a longitudinal direction. Further, the ink channels 107 adjacent to each other are defined by side walls 113. An upper side-wall surface of each of the side walls 113, there is formed an electrode 115. Also in a side wall surface of the ink channels 107 adjacent to each other, there is formed an electrode. Therefore, each of the side walls 113 is sandwiched between the electrode 115 and the electrode (not shown) formed on each of the side wall surfaces of each of the ink channels adjacent to each other.

The ink channels 107 are communicated to the nozzles 127, respectively. In the PZT sheet 103, there are formed, from a back side, a supply duct 132 and a discharge duct 133. The supply duct 132 and the discharge duct 133 are communicated to the ink channel 107 and to vicinities of both end portions of the ink channel 107. The ink is supplied through the supply duct 132, and the ink is discharged through the discharge duct 133. On a top surface of the PZT sheet 103, and at a right end portion and a left end portion of the ink channel 107, there are formed concave portions 129, respectively. In a bottom surface of each of the concave portions 129, there is formed an electrode, which is electrically conducted to the electrode 115 formed on the side wall surface of each of the ink channels 107. A connection terminal 134 is received in the concave portion 129. The connection terminal 134 is electrically connected to an electrode (not shown) formed on a bottom surface of the concave portion 129.

The ink-jet head 100 is operated as follows. The ink supplied from the supply duct 132 fills the ink channels 107, and is discharged through the discharge duct 133. In other words, the ink flows so as to circulate the supply duct 132, the ink channels 107, and the discharge duct 133. Then, if voltage is applied to the connection terminals 134 on the right side and the left side, the side walls of the ink channel 107 are deformed due to a piezoelectric thickness slip effect. With this deformation, the volume of the ink channel 107 is instantaneously reduced, and the inner pressure thereof is increased so that the droplets of the ink are discharged through the nozzle 127.

In the above-mentioned ink-jet discharging method, the ink circulates always through the supply duct 132 and the discharge duct 133. Therefore, even if foreign matters such as bubbles and dust are entered and mixed into the ink channels 107, it is possible to quickly discharge the foreign matters to an outside. Thus, it is possible to prevent such a failure that the ink can not be ejected due to clogging of the nozzles or a printing density is fluctuated.

However, in the above-mentioned conventional example of FIG. 9, a high-degree of technology is required to form the supply duct 132 and the discharge duct 133 in the vicinities of the both ends of the ink channels 107. Each of the plurality of ink channels 107 formed so as to be parallel to each other in the top surface of the PZT sheet 103 has, for example, a groove width of from 70 to 80 μm, a groove depth of from 300 to 400 μm, and a groove length of from several millimeters to 10 mm, and each of the walls defining the ink channels 107 adjacent to each other has a thickness of from 70 to 80 μm. The elongated groove of the ink channel 107 is formed by grinding the surface of the PZT sheet 103 under a state in which a dicing blade, which is obtained through embedding abrasive grains such as diamonds in an outer peripheral portion of a thin disk, is rotated at high speed. Therefore, a cross-section of the elongated groove has a convex shape in the depth direction. In particular, profile of a grinding blade is transferred to the vicinities of the both ends in the longitudinal direction of the elongated groove.

As a forming method for the ink channels 107 illustrated in FIG. 9, a case of forming the supply duct 132 and the discharge duct 133 after the plurality of grooves are formed is first taken into consideration. The supply duct 132 and the discharge duct 133 are required to be communicated to each other in the bottom portions of the plurality of grooves. However, in the vicinities of the both ends in the longitudinal direction of the each of the elongated grooves, the bottom surface of the each of the elongated grooves is not flat. For that reason, it is extremely difficult to form the supply duct 132 and the discharge duct 133 so as to conform to the bottom surface of each of the elongated grooves. Further, when the PZT sheet 103 is subjected to the cutting from the back side, the deepest portion of the elongated groove is first opened, and then the opening portion is gradually extended. However, when a part of the bottom surface of the elongated groove is opened, the side walls in vicinity of the opening portion are not supported anymore. Therefore, it is extremely difficult to grind the supply duct 132 and the discharge duct 133 without breaking the thin side walls 113 of the elongated groove including the opened bottom portion. Further, the electrodes are formed on the side walls defining the elongated grooves. When the PZT sheet 103 is deeply cut from the back side, there cause problems in that the electrode formed on the side wall of the elongated groove is also unfortunately ground, in that the voltage for driving the side wall is fluctuated, because the resistance of the electrode is increased, and the like.

In addition, when the supply duct 132 and the discharge duct 133 are tried to be formed in a region in which the bottom surface of the elongated groove is flat, the ink does not circulate anymore at the both end portions in the longitudinal direction of the elongated groove. Therefore, stagnation of the ink occurs, the bubbles and the dust are remained in the stagnation. Owing to this, advantage in the above-mentioned process of preventing clogging in the nozzles 127 and the like by removing the foreign matters from the ink channels 107 through the circulation of the ink.

Meanwhile, the following method is conceivable. Specifically, in the method, the supply duct 132 and the discharge duct 133 are first formed from a back side of the PZT sheet 103, and then the elongated grooves are formed from a front side of the PZT sheet 103. In this case, the supply duct 132 and the discharge duct 133 are easy to be ground, but high precision of control is required for forming the elongated grooves. The dicing blade has a diameter generally ranging from 2 inches to 4 inches. For example, in a case of forming a groove having, for example, a depth of 350 μm in the PZT sheet 103 from the front side thereof with use of the dicing blade having the diameter of 2 inches, if an allowance for the depth of the elongated groove is supposed to 10 μm, an allowance for the length of the elongated groove is about 120 μm which is 12 times as large as the depth of the elongated groove. In a case of using the dicing blade having the diameter of 4 inches, the allowance in the longitudinal direction is about 16 times as large as the allowance in the depth direction. Therefore, it is extremely difficult to cause the opening end portions of the supply duct 132 and the discharge duct 133 to correspond to the end portions in the longitudinal direction of the elongated groove, respectively. If positional shifting occurs between the end portion in the longitudinal direction of the elongated groove and an outer peripheral end portion of the supply duct 132, or between the end portion in the longitudinal direction of the elongated groove and an outer peripheral end portion of the discharge duct 133, the stagnation or resistance of an ink flow still occurs in the end portions of the ink channel 107. As a result, in the above-mentioned process, the advantage of preventing the clogging in the nozzles 127 through causing the ink to circulate is deteriorated.

Further, in the ink-jet head 100 described in Japanese Patent Translation Publication No. 2000-512233, the connection terminal 134 is received in the concave portion 129 formed on the top surface of the PZT sheet 103, and an outer surface of the cover 125 is formed into a flat surface. The electrode formed on a lower surface of the connection terminal 134 and the electrode formed on the side wall surface of the side wall defining the ink channels 107 are electrically connected to each other through intermediation of the side wall surface, the top surface of the PZT sheet 103, and the bottom surface of the concave portion 129. A large number of ink channels 107 are collectively formed in the direction orthogonal to the longitudinal direction, and hence it is necessary that the electrodes of the respective side walls be electrically separated from each other. Therefore, also in the top surface of the PZT sheet 103 and the bottom surface of the concave portion 129, it is necessary that the large number of the electrodes be similarly formed so as to be electrically separated from each other at high density. However, in particular, the bottom surface of the concave portion 129 is curved, a high-definition of patterning technology is required for highly-accurately forming an electrode pattern in the curved surface.

SUMMARY OF THE INVENTION

The present invention has been made in view of the above-mentioned circumstances, and it is an object of the present invention to provide a liquid jet head having a structure capable of reducing stagnation and residence of a liquid without requiring a high-degree of machining technology, and to provide a liquid jet apparatus using the liquid jet head, and a manufacturing method for the liquid jet head.

According to the present invention, there is provided a liquid jet head, including: a nozzle plate including a nozzle for ejecting a liquid onto a recording medium; a piezoelectric plate including an elongated groove formed at one surface, and joining the nozzle plate to another surface; and a cover plate including a liquid supply hole for supplying the liquid into the elongated groove, and a liquid discharge hole for discharging the liquid through the elongated groove, the cover plate being disposed on the one surface of the piezoelectric plate, in which: the cross-section of the elongated groove of the piezoelectric plate in a longitudinal direction and a depth direction of the elongated groove is a convex shape; the elongated groove is communicated, at a tip of the convex shape, to the nozzle; and the elongated groove is communicated, in a bottom portion of the convex shape, to the liquid supply hole and the liquid discharge hole.

Further, in the liquid jet head, the cross-section of the elongated groove has a circular-arc shape having a convex shape in the depth direction.

Further, in the liquid jet head, the elongated groove is communicated, in at least one of opening end portions in the longitudinal direction of the elongated groove, to one of the liquid supply hole and the liquid discharge hole.

Further, in the liquid jet head, the cover plate includes one of liquid discharge hole for discharging the liquid through the elongated groove and liquid supply hole for supplying the liquid into the elongated groove in multiple numbers.

Further, in the liquid jet head, the nozzle plate includes a plurality of nozzles communicated to the elongated groove.

Further, the liquid jet head further includes a channel member disposed on a surface opposite to the piezoelectric plate of the cover plate, the channel member including: a liquid supply chamber for holding the liquid to be supplied into the liquid supply hole; and a liquid discharge chamber for holding the liquid discharged from the liquid discharge hole.

Further, the liquid jet head further includes: a driver circuit for supplying a driving power to an electrode formed on a side wall of the elongated groove; a flexible printed circuit which includes the driver circuit mounted thereon, and which is disposed on the piezoelectric plate; and a base body for receiving the piezoelectric plate and the cover plate under a state in which the nozzle plate is exposed to an outside of the liquid jet head and for fixing the flexible printed circuit on an outer surface of the base body.

According to the present invention, there is provided a liquid ejection apparatus, including: the above-mentioned liquid jet head; a liquid tank for supplying a liquid into a liquid supply hole of a cover plate and for reserving the liquid discharged from a liquid discharge hole of the cover plate; a press pump for pressing the liquid and supplying the liquid from the liquid tank into the liquid supply hole; and a suction pump for sucking and discharging the liquid from the liquid discharge hole into the liquid tank.

Further, the liquid jet apparatus further includes, in a path between the liquid discharge hole and the liquid tank, a deaeration unit having a deaeration function.

According to the present invention, there is provided a manufacturing method for a liquid jet head, including: a groove processing step of forming, in one surface of a piezoelectric plate, an elongated groove having a convex shape in a depth direction; a cover plate bonding step of bonding a cover plate including a liquid supply hole and a liquid discharge hole onto the one surface of the piezoelectric plate; a cutting processing step of subjecting another surface of the piezoelectric plate to cutting processing; and a nozzle plate bonding step of bonding a nozzle plate, in which a nozzle for jetting the liquid is formed, onto the another surface of the piezoelectric plate to thereby cause the nozzle and the elongated groove to be communicated to each other.

Further, the manufacturing method for a liquid jet head according to the present invention further includes a channel member bonding step of bonding a channel member comprising: a liquid supply chamber for holding the liquid to be supplied into the liquid supply hole; and a liquid discharge chamber for holding the liquid discharged from the liquid discharge hole on a surface opposite to the piezoelectric plate of the cover plate.

The liquid jet head according to the present invention includes: the nozzle plate including the nozzle for ejecting the liquid onto the recording medium; the piezoelectric plate including the elongated groove formed at the one surface, and joining the nozzle plate to the another surface; and the cover plate including: the liquid supply hole for supplying the liquid into the elongated groove; and the liquid discharge hole for discharging the liquid through the elongated groove, the cover plate being disposed on the one surface of the piezoelectric plate. In the liquid jet head, the elongated groove of the piezoelectric plate includes the section extending in the longitudinal direction and the depth direction of the elongated groove, the section having the convex shape in the depth direction. The elongated groove is communicated, at the tip of the convex shape, to the nozzle. The elongated groove is communicated, in the bottom portion of the convex shape, to the liquid supply hole and the liquid discharge hole. With this structure, the liquid supplied into the elongated groove flows in from the one surface side having a large opening area of the elongated groove having a convex shape in a bottom portion thereof. Then, the liquid flows out from the same one surface side. Therefore, in the inside region of the elongated groove, the area of the region in which the liquid stagnates is reduced. Thus, it is possible to quickly remove foreign matters such as bubbles and dust from the inside region of the elongated groove. As a result, the clogging of the nozzle is reduced, thereby being capable of providing a highly-reliable liquid jet head.

DETAILED DESCRIPTION OF THE PREFERRED EMBODIMENTS

Figure 1:
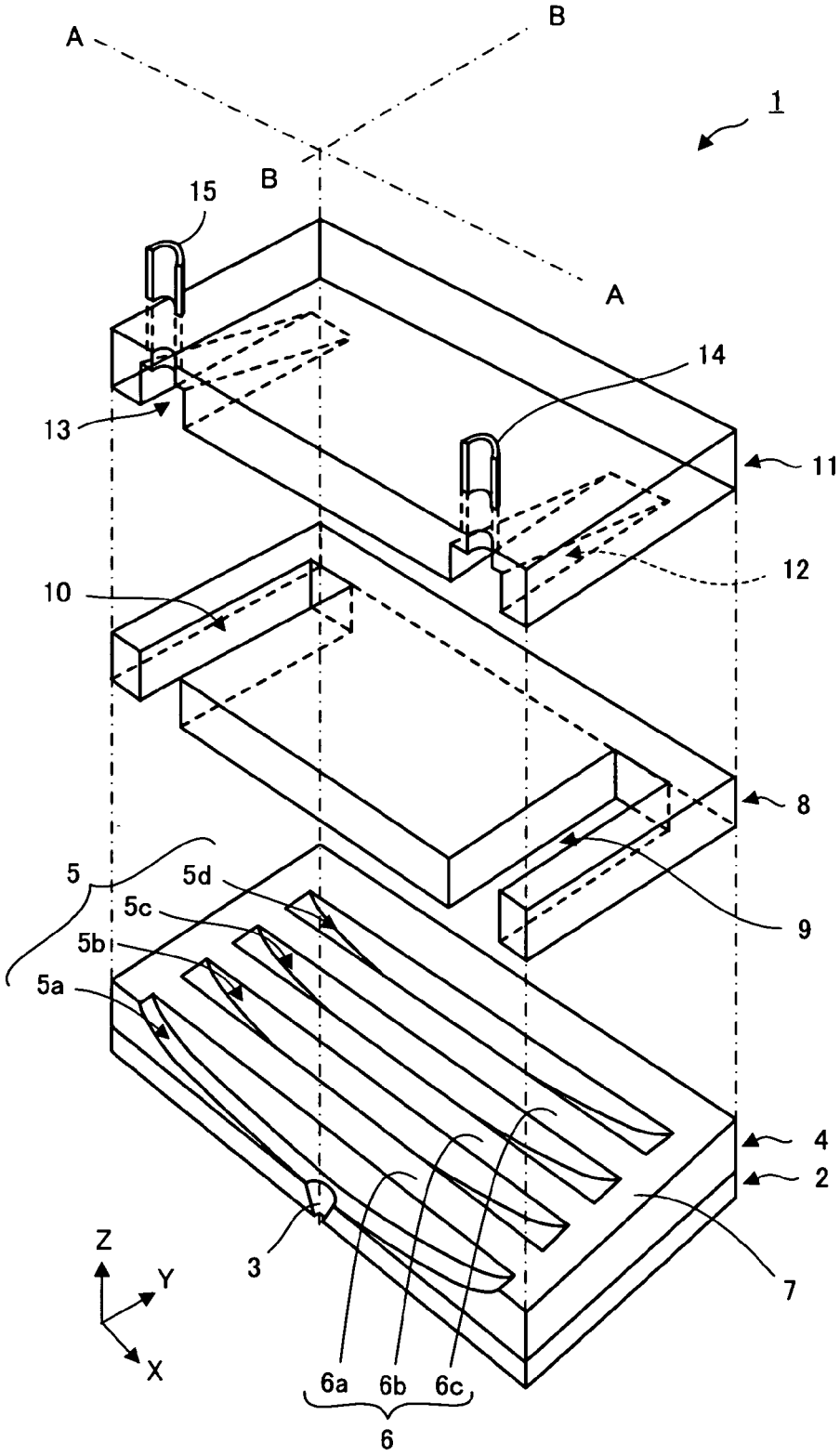
FIG. 1 is a schematic exploded perspective view of a liquid jet head according to a first embodiment of the present invention.

A liquid jet head according to the present invention includes a nozzle plate, a piezoelectric plate, and a cover plate. The nozzle plate includes a nozzle for jetting liquid onto a recording medium. The piezoelectric plate includes: an elongated groove formed at one surface; and joins the nozzle plate to the another surface. The cover plate includes: a liquid supply hole for supplying the liquid to be ejected into the elongated groove; and a liquid discharge hole for discharging the liquid supplied through the elongated groove. The cover plate is disposed on the one surface of the piezoelectric plate. In addition, a cross-section in the longitudinal direction of the elongated groove formed in the one surface of the piezoelectric plate has a convex shape in the depth direction. The elongated groove is communicated to the nozzle of the nozzle plate at a tip of the convex shape, that is, in a bottom portion of the elongated groove. In addition, the elongated groove is communicated, in the bottom portion of the convex shape, that is, in opening portions of the one surface in which the elongated groove is formed, to the liquid supply hole and the liquid discharge hole.

With this structure, the liquid flows in from the one surface side having a large opening area of the elongated groove, and the liquid flows out from the same one surface side having a large opening area of the elongated groove. Therefore, in an inside region of the elongated groove, an area of a region in which the liquid stagnates is reduced. Thus, it is possible to quickly remove foreign matters such as bubbles and dust from the inside region of the elongated groove. As a result, it is possible to reduce recording miss to be occurred due to clogging of the nozzle and fluctuation of a liquid amount ejected through the nozzle. Further, even if the bubbles and the like are entered and mixed into the elongated groove, it is possible to quickly remove the bubbles and the like. Consequently, even in a case where the present invention is industrially used for mass recording, it is possible to reduce a loss due to continuos occurrence of the recording misses.

Note that, a sectional shape of the elongated groove may be a circular-arc convex shape in the depth direction. The cross-section of the elongated groove is configured to have the circular-arc shape, to thereby reduce the stagnation in a flow from the liquid supply hole to the liquid discharge hole. Thus, it is possible to quickly discharge the foreign matters entered and mixed into the liquid. Further, a disc-like dicing blade is used to easily form the elongated groove by cutting.

Further, the cover plate can be disposed on the one surface of the piezoelectric plate so that the elongated groove formed in the one surface of the piezoelectric plate is communicated to the liquid supply hole or the liquid discharge hole in one opening end portion or both opening end portions in the longitudinal direction of the elongated groove. With this structure, it is possible to remove most of the region where the liquid stagnates from the inside of the elongated groove. Thus, it is possible to quickly remove the bubbles and the dust entered and mixed into the liquid.

Note that, in addition to one nozzle, a plurality of nozzles may be communicated to one groove. Further, one liquid supply hole or one liquid discharge hole may be communicated to one groove, or a plurality of liquid supply holes or a plurality of liquid discharge holes may be communicated to one groove. When the plurality of nozzles are provided, it is possible to increase a recording density or a recording speed.

Further, when the plurality of liquid supply holes or the plurality of liquid discharge holes are communicated to the one groove, it is possible to increase velocity of the liquid and to increase a speed for discharging the mixed foreign matters. Thus, it is possible to provide a highly reliable liquid jet head capable of suppressing the clogging in the nozzles from occurring.

Further, the one surface of the piezoelectric plate including the elongated grooves formed therein is flat. Therefore, it is possible to easily form an electrode terminal for connecting to a driver circuit on the one surface of the piezoelectric plate.

Further, a manufacturing method for the liquid jet head according to the present invention includes a groove processing step, a cover-plate bonding step, a cutting process step, and a nozzle-plate bonding step. In the elongated groove processing step, in one surface of the piezoelectric plate which is formed of a piezoelectric body or in which piezoelectric body is embedded, there are formed shallow grooves each having a convex shape in its depth direction. In the cover-plate bonding step, a cover plate including a liquid supply hole and a liquid discharge hole formed in another surface of the cover plate is prepared, and then the another surface of the cover plate is bonded onto the one surface of the piezoelectric plate. In the cutting process step, another surface of the piezoelectric plate is subjected to the cutting. In the nozzle-plate bonding step, a nozzle plate provided with a nozzle for jetting the liquid is prepared, and then the nozzle plate is bonded onto a cutting surface of the piezoelectric plate subjected to the cutting in such a manner that the nozzle and the elongated groove of the piezoelectric plate are communicated to each other.

The liquid jet head is manufactured in the above-mentioned manner, and thus it is possible to cause, without requiring a high-degree of cutting technology, the liquid supply hole 9 and the liquid discharge hole 10 to correspond or substantially correspond to both-end opening portions of the elongated grooves 5. As a result, the liquid supply hole and the liquid discharge hole can be communicated to the both-end opening portions of the elongated grooves. Further, if the another surface of the piezoelectric plate is subjected to the cutting after the cover-plate bonding step, it is easy to perform the cutting with respect to the piezoelectric plate because the cover plate serves as a reinforcing member for the piezoelectric plate. Hereinafter, the present invention is described in details with reference to embodiments thereof.

First Embodiment

Figure 2A:
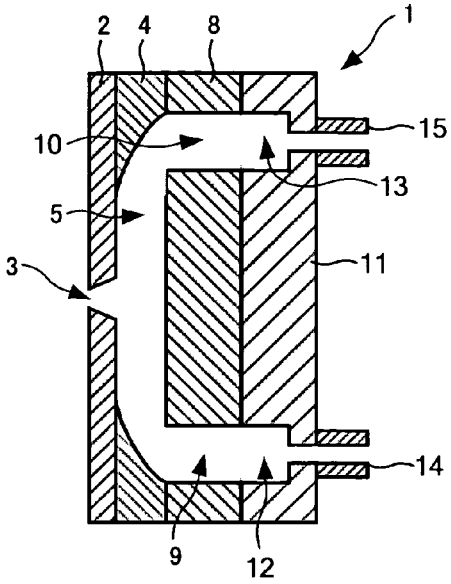
FIG. 2A to FIG. 2B are schematic vertical sectional views of the liquid jet head according to the first embodiment of the present invention.
Figure 2B:
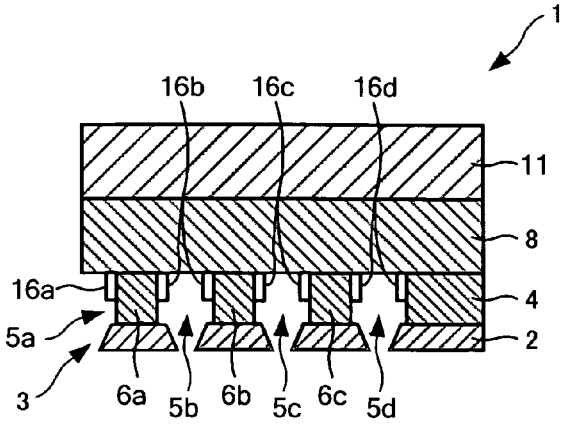

FIG. 1 is a schematic exploded perspective view of a liquid jet head 1 according to a first embodiment of the present invention. FIG. 2A is a schematic vertical sectional view of the portion AA of FIG. 1, FIG. 2B is a schematic vertical sectional view of the portion BB of FIG. 1, and FIG. 2B is a schematic vertical sectional view of the portion BB of FIG. 1.

The liquid jet head 1 has a structure in which a nozzle plate 2, a piezoelectric plate 4, a cover plate 8, and a channel member 11 are laminated on each other. As the piezoelectric plate 4, a piezoelectric ceramic including lead zirconate titanate (PZT) can be used, for example. The piezoelectric plate 4 includes, in one surface 7 thereof, a plurality of elongated grooves 5 (5*a*, . . . 5*d*). The respective elongated grooves 5*a*, . . . 5*d* have a longitudinal direction corresponding to an X-direction, and are arranged in a Y-direction orthogonal to the X-direction. The respective elongated grooves 5*a*, . . . 5*d* are defined by side walls 6*a*, 6*b*, 6*c*. Each of the elongated grooves may have, for example, a width of from 50 μm to 100 μm, and each of the side walls 6*a*, 6*b*, 6*c*, 6*d* defining the respective elongated grooves 5*a*, . . . 5*d* may have a width of from 50 μm to 100 μm similarly to the elongated grooves. A side surface on a front side of the piezoelectric plate 4 illustrated in FIG. 1 extends in the longitudinal direction of the elongated groove 5*a*. Here, a cross-section in a depth direction of the elongated groove 5*a* can be seen. A cross-section extending in the longitudinal direction (X-direction) and the depth direction (−Z-direction) of each of the elongated grooves 5*a*, . . . 5*d* has a convex shape in the depth direction. More specifically, the above-mentioned cross-section has a circular-arc shape having a convex shape in the depth direction.

The cover plate 8 is bonded and joined onto the one surface 7 of the piezoelectric plate 4. The cover plate 8 may be made of the same material as that for the piezoelectric plate 4. If the same material is used for the cover plate 8 and the piezoelectric plate 4, the cover plate 8 and the piezoelectric plate 4 have the same coefficient of thermal expansion with respect to a temperature change. Therefore, it is possible to suppress the cover plate 8 and the piezoelectric plate 4 from being deformed according to the ambient temperature change. In addition, it is possible to suppress the cover plate 8 and the piezoelectric plate 4 from being separated from each other. The cover plate 8 includes the liquid supply hole 9 and the liquid discharge hole 10, which extend from one surface to another surface of the cover plate 8.

The liquid supply hole 9 and the liquid discharge hole 10 of the cover plate 8 are configured so as to correspond or substantially correspond to both opening end portions in the longitudinal direction of each of the elongated grooves 5*a*, . . . 5*d*, respectively. Thus, a liquid stagnation region between the cover plate 8 and the piezoelectric plate 4 can be reduced in size. Further, each of the elongated grooves 5 includes the cross-section having the convex shape in the depth direction, and the liquid flows in and flows out from the one surface side including the large opening area in the bottom portion of the convex shape. Therefore, the liquid flows in the elongated groove 5 without stagnating. With this, it is possible to quickly remove the foreign matters entered and mixed into the liquid such as the bubbles and the dust from the region of the elongated groove 5.

The nozzle plate 2 is bonded and joined onto the another surface of the piezoelectric plate 4. The nozzle plate 2 may be made of a high-polymer material such as a polyimide resin. The nozzle plate 2 includes nozzles 3 extending from one surface of the nozzle plate 2 on the piezoelectric plate 4 side to another surface thereof on the opposite side. The nozzles 3 are respectively communicated to the elongated grooves 5 of the piezoelectric plate 4 at tips in the depth direction of the elongated grooves 5. Each of the nozzles 3 has a funnel shape having an opening cross-section decreasing from the one surface to the another surface of the nozzle plate 2. A tilted surface of the funnel shape forms, for example, a tilted angle of about 10° with respect to a normal line of the nozzle plate 2.

The channel member 11 is bonded and joined onto a top surface of the cover plate 8, the top surface being on a side opposite to the piezoelectric plate 4. The channel member 11 includes a liquid supply chamber 12 and a liquid discharge chamber 13. Each of the liquid supply chamber 12 and the liquid discharge chamber 13 is a concave portion in another surface of the channel member 11 on the cover plate 8 side. The liquid supply chamber 12 corresponds to and is communicated to the liquid supply hole 9 of the cover plate 8, and the liquid discharge chamber 13 corresponds to and is communicated to the liquid discharge hole 10 of the cover plate 8. The channel member 11 includes opening portions being communicated to the liquid supply chamber 12 and the liquid discharge chamber 13 in one surface of channel member 11, the one surface being opposite to the cover plate 8 side. In addition, the channel member 11 includes a supply joint 14 and a discharging joint 15 fixed to an outer periphery of each of the opening portions. The liquid supply chamber 12 includes, in order to reduce stagnation and residence of the liquid, an upper surface tilted from the liquid-supply opening portion toward a peripheral portion in a referential direction. As a result, a space in the liquid supply chamber 12 is decreased. The liquid discharge chamber 13 is structured similarly to the liquid supply chamber 12.

With this structure, the liquid supplied from the supply joint 14 fills the liquid supply chamber 12 and the liquid supply hole 9, and flows into the elongated grooves 5*a*, . . . 5*d*. In addition, the liquid discharged from the elongated grooves 5*a*, . . . 5*d* flows into the liquid discharge hole 10 and the liquid discharge chamber 13, and flows out through the discharging joint 15. Bottom surfaces of the elongated grooves 5*a*, . . . 5*d* are formed so that a depth of each of the elongated grooves 5*a*, . . . 5*d* is smaller toward the end portion in the longitudinal direction. Therefore, the liquid flows in the elongated grooves 5*a*, . . . 5*d* without stagnating.

The liquid jet head 1 operates as follows. First, the piezoelectric plate 4 is polarized. Further, as illustrated in FIG. 2B, on both side surfaces of the respective side walls 6*a*, 6*b*, 6*c*, driving electrodes 16*a*, 16*b*, 16*c*, 16*d* are formed in the following manner. Specifically, the side wall 6*a* is sandwiched between the driving electrode 16*a* and one of the driving electrodes 16*b*, and the side wall 6*b* is sandwiched between one of the driving electrodes 16*b* and one of the driving electrodes 16*c*, and the side wall 6*c* is sandwiched between one of the driving electrodes 16*c* and one of the driving electrodes 16*d*. Then, the supply joint 14 is supplied with the liquid to fill the elongated grooves 5*a*, 5*c* with the liquid. Then, a driving voltage is applied, for example, between the one of the driving electrodes 16*b* and the one of the driving electrodes 16*c* respectively formed on the side wall 6*b* and between the one of the driving electrodes 16*c* and the one of the driving electrodes 16*d* respectively formed on the side wall 6*c*. As a result, the side walls 6*b*, 6*c* are deformed due to a piezoelectric effect, for example, a piezoelectric thickness slip effect, and hence volume of the elongated groove 5*c* is changed. Due to the above-mentioned volume change, the liquid filled in the elongated groove 5*c* is ejected through the nozzles 3*a*. The other respective side walls 6*b*, 6*c* may similarly be driven independently. For example, if ink is used as the liquid, it is possible to perform drawing on a sheet as a recording medium. If a liquid metal material is used as the liquid, it is possible to form electrode patterns on a substrate.

In particular, as illustrated in the first embodiment, the liquid-supplying/discharging cover plate 8 is provided on the opening portion side of the elongated grooves 5, and the bottom portion of each of the elongated grooves is set to have the circular-arc shape having a convex shape in the depth direction. Thus, even in a case where foreign matters such as bubbles and the dust are entered and mixed into the respective grooves 5*a*, 5*b*, 5*c*, it is possible to reduce a resistance time period of the foreign matters, thereby being capable of lowering a probability of causing such a failure that the nozzles 3 are clogged and a liquid ejecting pressure is absorbed by the mixed bubbles.

Note that, a plurality of grooves 5 including several grooves 5 and several hundreds of grooves 5 or more, for example, may be formed in the piezoelectric plate 4. A vertical cross-section in the longitudinal direction of each of the elongated grooves 5 may have an inverse trapezoid convex shape in the depth direction thereof. Otherwise, both side surfaces in the longitudinal direction of each of the elongated grooves 5 may have a circular-arc convex shape in a lateral direction or the depth direction, and a bottom side of each of the elongated grooves 5 may be flat. Further, the elongated groove 5*d* at an end portion in the Y-direction of the piezoelectric plate 4 is intended to form an electrode on the side wall 6*c*. Therefore, the elongated groove 5*d* is not necessarily needed to be communicated to the nozzle 3, the liquid supply hole 9, and the liquid discharge hole 10.

Further, although positions of the nozzles 3 respectively being communicated to the elongated grooves 5 in the bottom side of the elongated grooves are not particularly limited, it is preferred that each of the positions of the nozzles 3 be set in a symmetrical axis or a symmetrical center of the longitudinal direction (X-direction) and a width direction (Y-direction) of each of the elongated grooves 5. An impact wave to be applied to the liquid due to deformation of the side walls 6 is liable to converge at the position in the symmetrical axis or the symmetrical center in a region of the respective grooves 5, and the liquid ejecting pressure through the nozzles 3 is allowed to be the highest.

Further, though specifically described later, the another surface of the piezoelectric plate 4 is subjected to the cutting after the elongated grooves 5 are formed on the one surface 7 of the piezoelectric plate 4 and the cover plate 8 is bonded and fixed onto the one surface 7. When the another surface of the piezoelectric plate 4 is subjected to the cutting, the another surface of the piezoelectric plate 4 may be cut until bottom surfaces of the elongated grooves 5 are opened. Otherwise, the cutting may be stopped before the bottom surfaces of the elongated grooves 5 are opened, to thereby leave a thinned piezoelectric material in the bottom surfaces of the elongated grooves 5. When the thinned piezoelectric material is left in the bottom surfaces of the elongated grooves 5, it is necessary to form through-holes corresponding to the nozzles 3 of the nozzle plate 2. For that reason, high accuracy pouncing is required and the number of steps is also increased. Further, the piezoelectric material is left on a bottom side of the elongated grooves 5, and hence a distance from the region of each of the elongated grooves 5 up to a discharge port of each of the nozzles 3 is increased. As a result, a resistance in the channel is increased and a discharge speed is decreased. Therefore, it is preferred that the bottom portions of the elongated grooves 5 are opened, to thereby set the top surface of the nozzle plate 2 to be the bottom sides of the elongated grooves 5.

Further, in the above-mentioned first embodiment, although the channel member 11 is provided, to thereby allow the liquid which is supplied and discharged to flow without stagnating, the channel member 11 is not necessarily required in the present invention. In particular, even in a case where the number of the elongated grooves 5 is small, or even in a case where the number of the elongated grooves 5 is large, the cover plate 8 can be constructed to have the same function as that of the channel member 11.

Further, though, in the first embodiment, as illustrated in FIG. 2B, the plurality of nozzles 3 are arranged in one row parallel to the Y-direction, the present invention is not limited thereto. A predetermined number of the nozzles 3 may be obliquely arranged while each forming an angle with respect to the Y-direction. For example, in a case of driving, in three cycles, the driving electrodes 16 formed in the respective side walls 6, three nozzles 3 each are provided obliquely with respect to the Y-direction. Further, the driving signals are supplied to the adjacent nozzles 3 in time sequence, and the recording medium is conveyed synchronously with the driving signals. With this, it is possible to independently drive the adjacent nozzles 3 and to perform a record on the recording medium at high speed.

Second Embodiment

Figure 3:
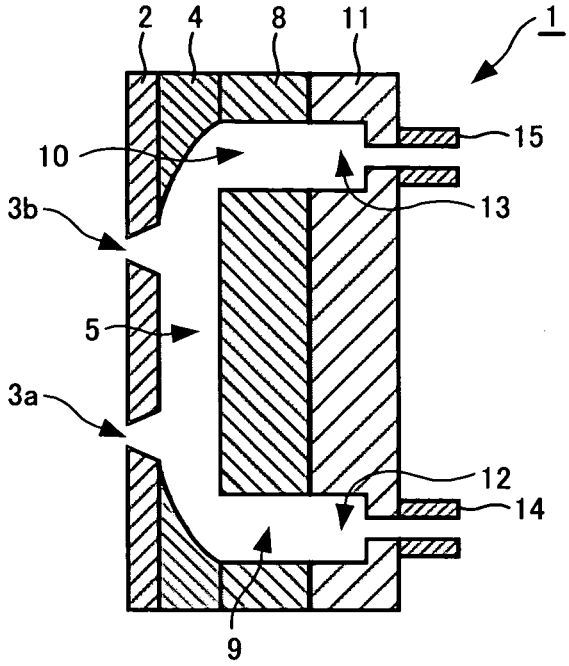
FIG. 3 is a schematic vertical sectional view of a liquid jet head according to a second embodiment of the present invention.

FIG. 3 is a schematic vertical sectional view of a liquid jet head 1 according to a second embodiment of the present invention. The second embodiment is similar to the first embodiment except such a difference that the nozzle plate 2 includes two nozzles 3*a*, 3*b* corresponding to one groove. In the following, portions of the second embodiment different from those of the first embodiment are mainly described. Further, in the following, the same portions or portions having the same functions as those of the first embodiment are denoted by the same reference symbols.

As illustrated in FIG. 3, the liquid jet head 1 has a structure in which the nozzle plate 2, the piezoelectric plate 4, the cover plate 8, and the channel member 11 are stacked on each other in this order. The piezoelectric plate 4 includes, in one surface thereof, the elongated groove 5 and the shallow groove 5 arranged to be adjacent to the elongated groove 5 and to be orthogonal to a strip and longitudinal direction. The elongated groove 5*a* has a convex shape in the depth direction, and two nozzles 3*a*, 3*b* of the nozzle plate 2 are communicated to the elongated groove 5 at the tip of the convex shape. The nozzle 3*a* is positioned on one end side with respect to a center portion in the longitudinal direction of the elongated groove 5, and the nozzle 3*b* is positioned on another end side with respect to the center portion in the longitudinal direction of the elongated groove 5. The liquid supplied through the supply joint 14 flows through the liquid supply chamber 12 and the liquid supply hole 9 into an opening portion on one end of the elongated groove 5. Then, the liquid flows out through an opening portion on the another end of the elongated groove 5, the liquid discharge hole 10, and the liquid discharge chamber 13 into the discharging joint 15. Note that, here, the tip of the convex shape in the depth direction of the elongated groove 5 does not necessarily mean only a deepest portion of the elongated groove 5, and, if the elongated groove 5 has an extent in the bottom side thereof, the bottom side with the extent is called the tip. The same is true in the case of the other embodiments.

One or both end opening portions of the elongated groove 5 formed in the piezoelectric plate 4 correspond or substantially correspond to opening portions of the liquid supply hole 9 and the liquid discharge hole 10 of the cover plate 8. Further, the elongated groove 5 has a cross-section having a convex shape toward the nozzle plate 2. Therefore, between the cover plate 8 and the piezoelectric plate 4 and in an inside of the elongated groove 5, stagnation of liquid flow is difficult to occur. In addition, even if the bubbles and the dust are entered and mixed into the elongated grooves, the bubbles and the dust are quickly discharged. Consequently, it is possible to reduce such a failure that the nozzles 3 are clogged and the liquid is not discharged through the nozzles 3 because the liquid ejecting pressure in the elongated grooves is absorbed by the mixed bubbles as an air spring.

Driving electrodes (not shown) formed on the side surfaces of the side walls defining the elongated groove 5 are electrically separated from each other in the center portion in the longitudinal direction of the elongated groove 5. In a case of ejecting the liquid through the nozzle 3*a*, a driving voltage is applied to the driving electrode on the nozzle 3*a* side, to thereby deform the side wall on the nozzle 3*a* side. In a case of ejecting the liquid through the nozzle 3*b*, a driving voltage is applied to the driving electrode on the nozzle 3*b* side, to thereby deform the side wall on the nozzle 3*b* side. That is, it is possible to independently eject the liquid through the two nozzles, thereby being capable of increasing a recording density and a recording speed.

Third Embodiment

Figure 4:
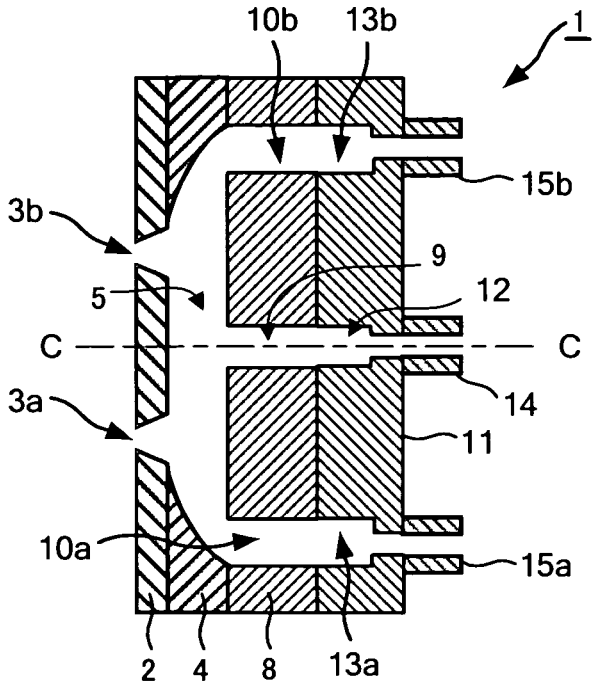
FIG. 4 is a schematic vertical sectional view of a liquid jet head according to a third embodiment of the present invention.

FIG. 4 is a schematic vertical sectional view of a liquid jet head 1 according to a third embodiment of the present invention. The third embodiment is similar to the first embodiment except such a difference that the nozzle plate 2 includes the two nozzles 3*a*, 3*b* corresponding to one groove 5, and that the cover plate 8 includes the one liquid supply hole 9 and two liquid discharge holes 10*a*, 10*b*. In the following, description is made mainly of portions different from those of the first embodiment.

As illustrated in FIG. 4, the liquid jet head 1 has a structure in which the nozzle plate 2, the piezoelectric plate 4, the cover plate 8, and the channel member 11 are stacked on each other in this order. The piezoelectric plate 4 includes, in one surface thereof, the elongated groove 5 arranged to be adjacent to the elongated groove 5 and to be orthogonal to the longitudinal direction. The elongated groove 5 has a cross-section in the longitudinal direction and the depth direction, the cross-section having a convex shape in the depth direction. The cover plate 8 includes: the liquid supply hole 9 corresponding to a center opening portion in the longitudinal direction of the elongated groove 5; and the two liquid discharge hole 10*a*, 10*b* corresponding to opening portions at both ends in the longitudinal direction of the elongated groove 5. In other words, the elongated groove 5 communicates to the liquid supply hole 9 and the liquid discharge hole 10*a*, 10*b* at the bottom portion having a convex shape in cross-section.

The channel member 11 includes: the liquid supply chamber 12 corresponding to the liquid supply hole 9 of the cover plate 8; and liquid discharge chambers 13*a*, 13*b* respectively corresponding to the two liquid discharge holes 10*a*, 10*b*. The liquid supply chamber 12 is opened in one surface opposite to the cover plate 8, for supplying the liquid through the supply joint 14 provided in an outer periphery of the opening portion. The liquid discharge chambers 13*a*, 13*b* are opened toward one surface of the cover plate 8, for discharging the liquid through discharging joints 15*a*, 15*b* provided in an outer periphery of the opening portions. The elongated groove 5 has a convex shape in the depth direction, and the two nozzles 3*a*, 3*b* of the nozzle plate 2 are communicated to the elongated groove 5 at the tip thereof. The nozzle 3*a* is positioned between the liquid supply hole 9 and the liquid discharge hole 10*a*, and the nozzle 3*b* is positioned between the liquid supply hole 9 and the liquid discharge hole 10*b*.

The liquid supplied through the supply joint 14 flows through the liquid supply chamber 12 and the liquid supply hole 9 into a center portion of the elongated groove 5. Then, the liquid flows through both end portions of the elongated groove 5, the two liquid discharge holes 10*a*, 10*b*, and the liquid discharge chambers 13*a*, 13*b* before the liquid flows out of the discharging joints 15*a*, 15*b* to the outside. The both-end opening portions of the elongated groove 5 formed in the piezoelectric plate 4 correspond or substantially correspond to the opening portions of the two liquid discharge holes 10*a*, 10*b* of the cover plate 8. Further, the elongated groove 5 has a cross-section having a convex shape toward the nozzle plate 2. Therefore, between the cover plate 8 and the piezoelectric plate 4 and in the inside of the elongated groove 5, stagnation and residence of the liquid are reduced. In addition, even if bubbles and dust are entered and mixed into the elongated grooves, the bubbles and the dust are quickly discharged. Consequently, the clogging of the nozzles 3 may be reduced.

The driving electrodes (not shown) provided on the side wall surfaces, for deforming the side walls defining the elongated grooves 5 are electrically separated from each other in center portions in the longitudinal direction of the elongated groove 5 and the shallow groove 5*b*. In a case of ejecting the liquid through the nozzle 3*a*, the driving voltage is applied to the driving electrodes on the nozzle 3*a* side, to thereby deform the side walls on the nozzle 3*a* side. In a case of ejecting the liquid through the nozzle 3*b*, the driving voltage is applied to the driving electrodes on the nozzle 3*b* side, to thereby deform the side walls on the nozzle 3*b* side. With this, it is possible to increase the recording density or the recording speed with use of the liquid. In addition, the shape the elongated groove 5 and the flow of the liquid are symmetrical about the center line CC of the elongated groove 5. Therefore, an ejecting condition for jetting the liquid drops through the nozzle 3*a* and an ejecting condition for ejecting the liquid drops through the nozzle 3*b* can be set to the same. For example, it is facilitated to set a liquid drop amount of the liquid drops to be jetted and a liquid jetting timing to the same between the nozzle 3*a* and the nozzle 3*b*.

Note that, in the above-mentioned third embodiment, the liquid is supplied from the center portion of the elongated groove 5 and the liquid is discharged from the both end portions of the elongated groove 5, but the present invention is not limited thereto. For example, the liquid may be supplied from the both end portions of the elongated groove 5, and may be discharged from the center portion of the elongated groove 5. Further, the number of the liquid discharge holes 10 or the liquid supply holes 9 may be further increased.

Fourth Embodiment

Figure 5B:
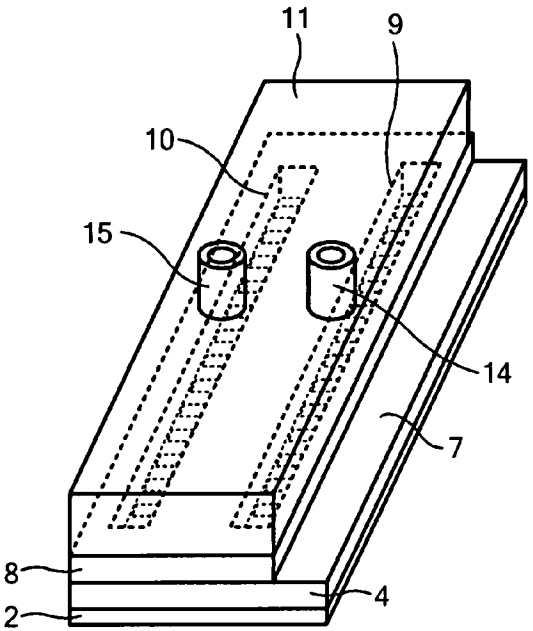
FIG. 5A and FIG. 5B are schematic perspective views of a liquid jet head according to a fourth embodiment of the present invention.
Figure 5A:
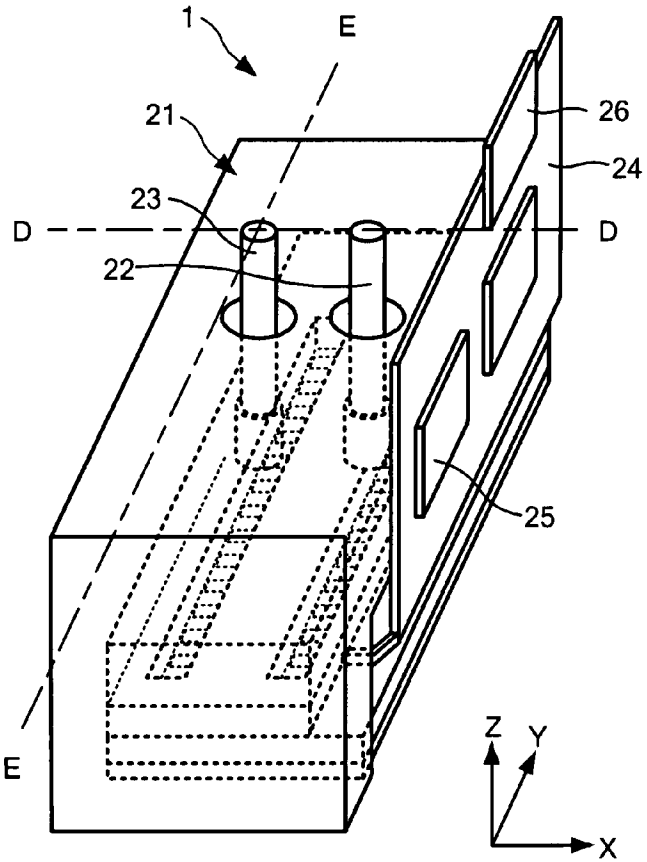
Figure 6B:
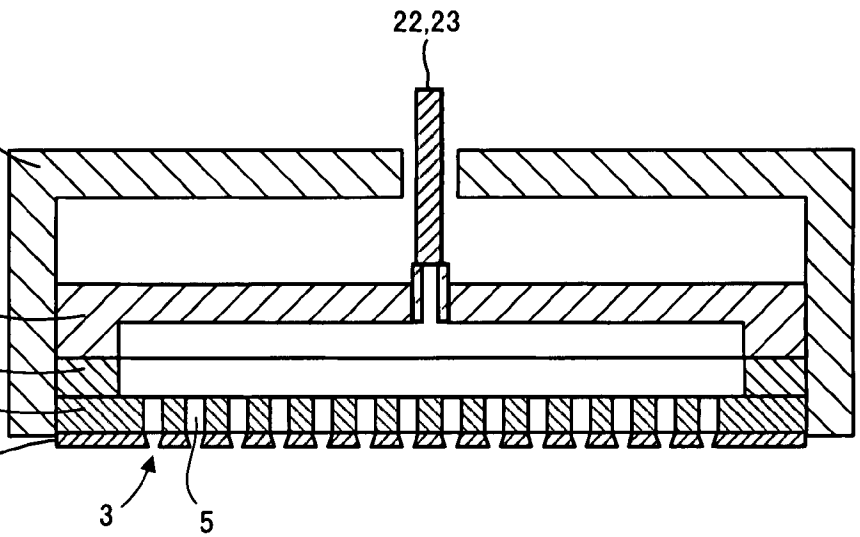
FIG. 6A and FIG. 6B are schematic vertical sectional views of the liquid jet head according to the fourth embodiment of the present invention.
Figure 6A:
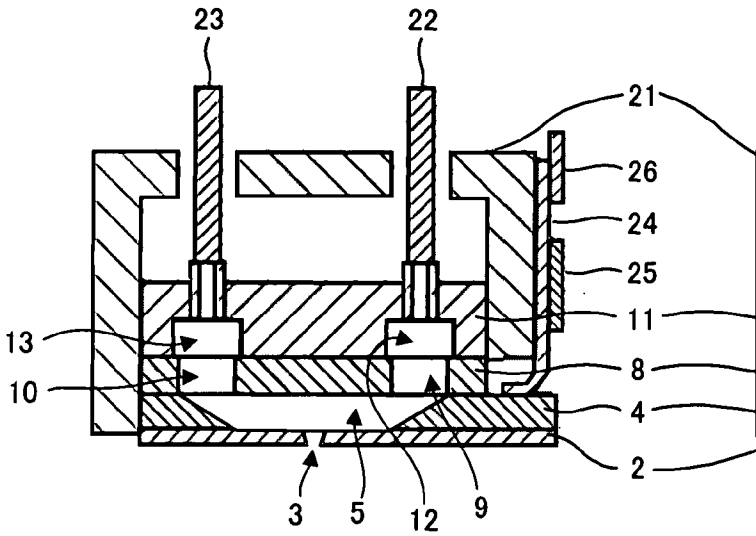

FIG. 5A and FIG. 5B and FIG. 6A and FIG. 6B are explanatory views of the liquid jet head 1 according to a fourth embodiment of the present invention. FIG. 5A is a general perspective view of the liquid jet head 1, and FIG. 5B is an internal perspective view of the liquid jet head 1. FIG. 6A is a vertical sectional view of the portion DD of FIG. 5A, and FIG. 6B is a vertical sectional view of the portion EE of FIG. 5A.

As illustrated in FIG. 5A and FIG. 5B, the liquid jet head 1 has a structure in which the nozzle plate 2, the piezoelectric plate 4, the cover plate 8, and the channel member 11 are stacked on each other. The nozzle plate 2 and the piezoelectric plate 4 each have a width in the X-direction, which is larger than those of the cover plate 8 and the channel member 11. Further, the nozzle plate 2 and the piezoelectric plate 4 each protrude at one end thereof in the X-direction with respect to the cover plate 8 and the channel member 11. In the one surface 7 of the piezoelectric plate 4, a large number of the elongated grooves 5 and a large number of shallow grooves 5*b* are alternately arranged in the Y-direction, that is, independently and alternately. The cover plate 8 includes the liquid supply hole 9 and the liquid discharge hole 10 each extending from the one surface to the another surface. The opening portions in the another surface of the liquid supply hole 9 and the liquid discharge hole 10 correspond or substantially correspond and are communicated respectively to the opening portions on the one end and the another end in the longitudinal direction (X-direction) of the respective grooves 5.

As illustrated in FIG. 6A and FIG. 6B, the channel member 11 includes the liquid supply chamber 12 and the liquid discharge chamber 13, which are formed of concave portions opened to the another surface on the cover plate 8 side. The channel member 11 includes, in the one surface opposite to the cover plate 8, the supply joint 14 and the discharging joint 15, which are respectively communicated to the liquid supply chamber 12 and the liquid discharge chamber 13.

A large number of electrode terminals are collectively formed on the one surface 7 on the one end to which the piezoelectric plate 4 protrudes. The electrode terminals are electrically connected to the driving electrodes (not shown) formed on the side walls of the elongated grooves 5, respectively. A flexible printed circuit (hereinafter, referred to as FPC) 24 is bonded to be fixed onto the one surface 7 of the piezoelectric plate 4. The FPC 24 includes a large number of electrodes electrically separated from each other in the surface on the piezoelectric plate 4 side. The electrodes are electrically connected to the electrical terminals on the piezoelectric plate 4 through intermediation of an electrical conductive material, respectively. The FPC 24 includes, in a surface thereof, a connector 26 and driver ICs 25 serving as driver circuits. The driver ICs 25 generate the driving voltage for driving the respective side walls of the elongated grooves 5 when a driving signal is input through the connector 26, and the driver ICs 25 supply the driving voltage into the driving electrodes (not shown) of the side walls through intermediation of the electrodes on the FPC 24, and of the electrode terminals on the piezoelectric plate 4.

A base 21 houses the piezoelectric plate 4 and the like. To a lower surface of the base 21, a liquid ejecting surface of the nozzle plate 2 is exposed. The FPC 24 is pulled out from the convex end portion side of the piezoelectric plate 4 to the outside, and is fixed onto an outer surface of the base 21. The base 21 includes two through-holes in an upper surface thereof. A supply tube 22 for supplying the liquid protrudes through one of the through-holes so as to be connected to the liquid supply joint 14, and a discharge tube 23 for discharging the liquid protrudes through the other of the through-holes so as to be connected to the discharging joint 15.

Each of the nozzles 3 of the nozzle plate 2 is communicated to the tip of the shape having a convex shape in the depth direction of each of the elongated grooves 5. The nozzle 3 formed in the nozzle plate 2 are arranged at one raw in the Y-direction, and are communicated to the elongated grooves 5, respectively. The cover plate 8 is joined onto the one surface 7 of the piezoelectric plate 4 so that the opening end portions of the liquid supply hole 9 and the liquid discharge hole 10 correspond or substantially correspond to the one opening end portion and the another opening end portion of the elongated grooves 5, respectively. Specifically, and so that the opening portions of the shallow grooves 5*b* are closed. The elongated groove 5 is communicated, at a bottom portion having a convex sectional shape, to the liquid supply hole 9 and the liquid discharge hole 10. The FPC 24 is fixed to the side wall of the base 21.

With this structure, the stagnation of the liquid is reduced between the cover plate 8 and the piezoelectric plate 4 and in the inside of each of the elongated grooves 5, and thus the bubbles and the dust which are entered and mixed into the liquid are quickly discharged. Consequently, it is possible to lower the probability of generating failure such as the clogging in the nozzles 3 and discharging amount insufficiency of the liquid. Further, when the driver ICs 25 and the side walls of the elongated grooves 5 of the piezoelectric plate 4 is heated due to driving thereof, and the heat is transmitted through intermediation of the base 21 and the channel member 11 to the liquid flowing in the inside. That is, it is possible to efficiently release the heat to the outside while using, as a cooling medium, the liquid for performing a record on the recording medium. Thus, it is possible to prevent a driving performance from being lowered due to excessive heating of the driver ICs 25 and the piezoelectric plate 4. Therefore, it is possible to provide the highly reliable liquid jet head 1.

Note that, as in the second embodiment, the two nozzles 3 may be provided to the one groove. Further, as in the third embodiment, the liquid may be supplied through the liquid supply chamber 12 and the liquid supply hole 9 from the center portion of the elongated grooves 5, and the liquid may be discharged from the both end portions of the elongated grooves 5 through the liquid discharge holes 10*a*, 10*b* and the liquid discharge chambers 13*a*, 13*b*. Further, the liquid may be ejected independently through the two nozzles. Further, it is not essential that the nozzles 3 provided in the nozzle plate 2 are arranged at one raw in the Y-direction as illustrated in FIG. 6B. The nozzles 3 provided in the nozzle plate 2 may be arranged while each forming an angle with respect to the Y-direction at certain intervals.

Fifth Embodiment

Figure 7:
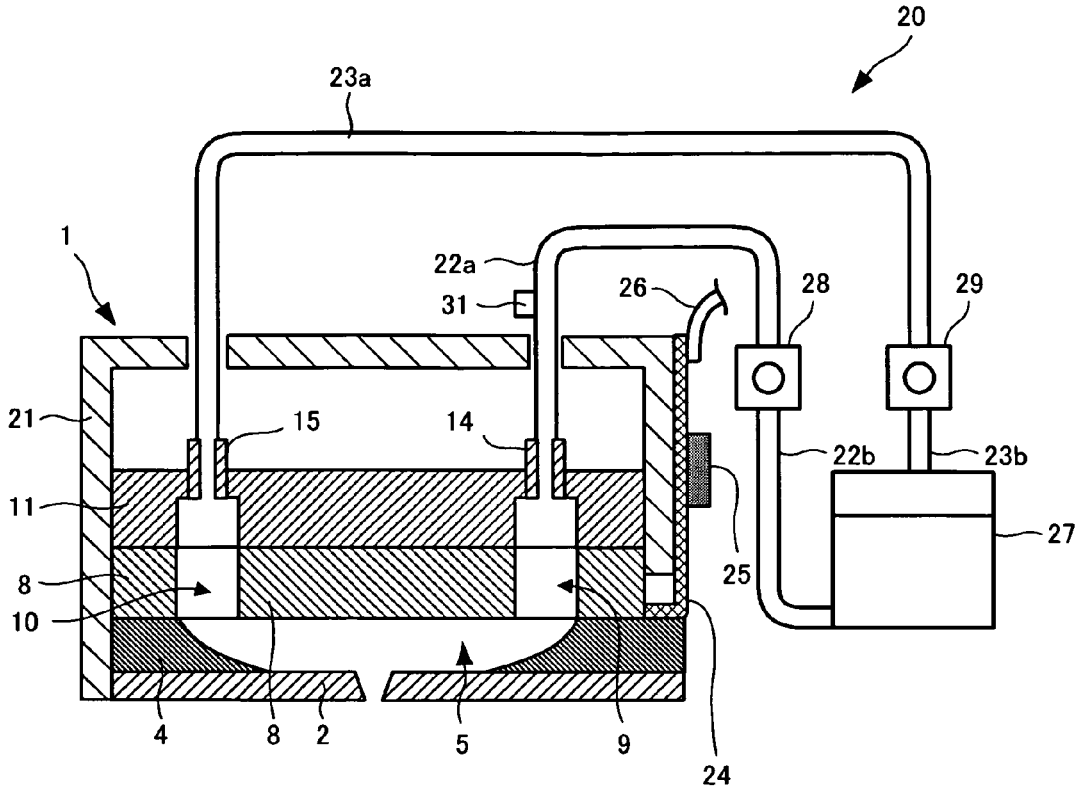
FIG. 7 is an explanatory view of a liquid jet apparatus according to a fifth embodiment of the present invention.

FIG. 7 is a schematic structural view of a liquid jet apparatus 20 according to a fifth embodiment of the present invention. The liquid jet apparatus 20 supplies the liquid into the liquid jet head 1, and includes a liquid tank 27, a press pump 28, and a suction pump 29. The liquid tank 27 reserves the liquid discharged from the liquid jet head 1. The press pump 28 presses the liquid and supplies the liquid from the liquid tank 27 into the liquid jet head 1. The suction pump 29 sucks the liquid and discharges the liquid from the liquid jet head 1 into the liquid tank 27. A suction side of the press pump 28 and the liquid tank 27 are connected to each other through a supply tube 22*b*. A pressing side of the press pump 28 and the supply joint 14 of the liquid jet head 1 are connected to each other through a supply tube 22*a*. A pressing side of the suction pump 29 and the liquid tank 27 are connected to each other through a discharge tube 23*b*. A suction side of the suction pump 29 and the discharging joint 15 of the liquid jet head 1 are connected to each other through the discharge tube 23*a*. The supply tube 22*a* includes a pressure sensor 31 for detecting a pressure of the liquid pressed by the press pump 28. The liquid jet head 1 is similar to that of the fourth embodiment, and hence a description thereof is omitted.

Note that, as described above, as in the second embodiment, the two nozzles 3 may be provided to the one groove 5 in the liquid jet head 1. Further, as in the third embodiment, the liquid may be supplied through the liquid supply chamber 12 and the liquid supply hole 9, which is provided correspondingly to the liquid supply chamber 12, from the center portion of the elongated groove 5, and the liquid may be discharged from the both end portions of the elongated groove 5 through the two liquid discharge holes 10*a*, 10*b* and the two liquid discharge chambers 13*a*, 13*b* provided correspondingly to the liquid discharge holes 10*a*, 10*b*. In addition, the liquid may be ejected independently through the two nozzles. Further, though the liquid jet apparatus 20 includes: a conveyor belt for causing the liquid jet head 1 to reciprocate; a guide rail for guiding the liquid jet head 1; a driving motor for driving the conveyor belt; a conveying roller for conveying the recording medium; a control portion for controlling driving of those members; and the like, the above-mentioned members are not shown in FIG. 7.

Further, in this embodiment, a deaerator (not shown) may be provided between the liquid discharge hole 10 and the liquid tank 27. In other words, the deaerator may be provided to the discharge tube 23*a* or 23*b*. When the above-mentioned structure is employed, it is possible to exhaust or remove gas contained in the liquid in a path of the discharge tubes 23*a* and 23*b* for causing the liquid, which is supplied from the liquid tank 27 to the elongated grooves 5, to circulate from the elongated grooves 5 to the liquid tank 27. That is, the circulating path is provided with a deaeration function, and thus it is possible to reduce a content of the gas contained in the liquid, to thereby supply the liquid suitable for a liquid discharging environment into the liquid tank 27. Therefore, it is possible to configure an excellent liquid re-use system.

The liquid jet apparatus 20 is structured as described above, and hence the stagnation or the residence of the liquid is reduced between the cover plate 8 and the piezoelectric plate 4, and in the inside of each of the elongated grooves 5. Therefore, even if the bubbles and the dust are entered and mixed into the inside, the liquid is quickly discharged. Further, the heat generated in the driver ICs 25 and the side walls of the piezoelectric plate 4 is transmitted through intermediation of the base 21 and the channel member 11 to the liquid flowing in the inside. Therefore, it is possible to efficiently release the heat to the outside while using, as the cooling medium, the liquid for performing the record on the recording medium. Thus, it is possible to prevent the driving performance from being lowered due to the excessive heating of the driver ICs 25 and the side walls. Therefore, it is possible to provide the highly reliable liquid jet apparatus 20.

Sixth Embodiment

FIG. 8A to FIG. 8E are explanatory views illustrating a manufacturing method for the liquid jet head 1 according to a sixth embodiment of the present invention. The same portions or portions having the same function as those of the above-mentioned embodiments are denoted by the same reference symbols.

Figure 8A:
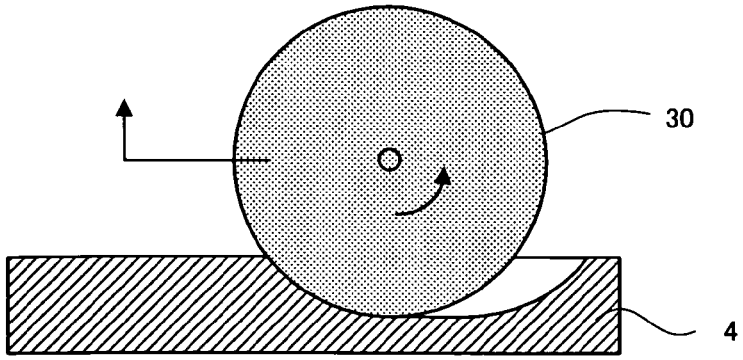
FIG. 8A to FIG. 8E are flow charts illustrating a manufacturing method for a liquid jet head according to a sixth embodiment of the present invention.
Figure 8B:
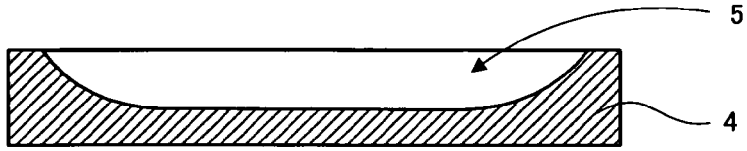

FIG. 8A illustrates groove machining steps of performing the cutting on the one surface 7 of the piezoelectric plate 4 with use of a dicing blade 30 to form the elongated groove 5. The piezoelectric plate 4 is made of a PZT ceramic. The dicing blade 30 is made of a metal plate or a synthetic resin having a disk shape, and diamond grains for the cutting are embedded in an outer peripheral portion thereof. The rotating dicing blade 30 is lowered up to a predetermined depth in one end portion of the piezoelectric plate 4, and then the cutting is performed horizontally up to the another end portion of the piezoelectric plate 4 before the dicing blade 30 is raised. FIG. 8B illustrates a cross-section of the elongated groove 5 after the cutting. A profile of the dicing blade 30 is transferred to both end portions of the elongated groove 5, and the cross-section of the elongated groove 5 has the circular-arc shape having a convex shape in the depth direction. Further, on a deep side or on a front side of the elongated groove 5 on the sheet of the drawing, the shallow groove 5*b* is formed so as to be adjacent to the elongated groove 5.

Figure 8C:
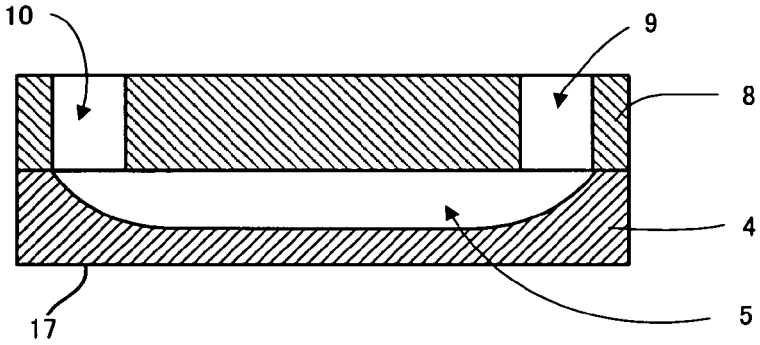

FIG. 8C illustrates a vertical sectional view of the liquid jet head after a cover plate bonding step of bonding and joining the cover plate 8 including the liquid supply hole 9 and the liquid discharge hole 10 onto the one surface 7 of the piezoelectric plate 4. The cover plate 8 is formed of the same material as that for the piezoelectric plate 4, and joined with an adhesive onto the one surface 7 of the piezoelectric plate 4. The opening end portion of the liquid supply hole 9 and the opening end portion of the elongated groove 5 are configured to correspond or substantially correspond to each other. Further, the opening end portion of the liquid discharge hole 10 and the another opening end portion of the elongated groove 5 are configured to correspond or substantially correspond to each other. The cover plate 8 is bonded to the elongated groove 5 side. Therefore, positioning becomes extremely easy to be performed between the both end portions of the elongated groove 5 and the opening end portions of the liquid supply hole 9 and the liquid discharge hole 10, respectively. The liquid supply hole 9 and the liquid discharge hole 10 substantially correspond to the both end portions of the elongated grove 5. In addition, The elongated groove 5 has the circular-arc shape having a convex shape in the depth direction. With this structure, when the liquid flows from the liquid supply hole 9 into the elongated groove 5 and then the liquid is discharged through the liquid discharge hole 10, it is possible to suppress the stagnation and the residence in the inside of the elongated groove 5 from occurring.

Figure 8D:
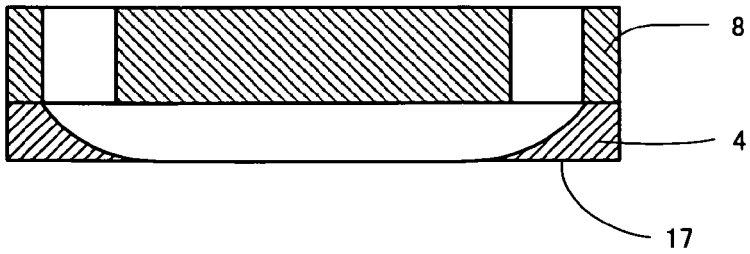

FIG. 8D illustrates a vertical sectional view of the liquid jet head after a cutting step of cutting another surface 17 of the piezoelectric plate 4, to thereby open the tip in the depth direction of the elongated groove 5. The cover plate 8 is joined onto the one surface of the piezoelectric plate 4, and hence the cover plate 8 functions as a reinforcing member for the piezoelectric plate 4. Therefore, the another surface 17 of the piezoelectric plate can be easily cut with a grinder. With the grinder, the piezoelectric plate 4 can be ground from the another surface 17 side so that the piezoelectric plate 4 is polished. Therefore, it is possible to open the bottom surface of the elongated groove 5 without breaking the side wall 6 defining the elongated groove 5.

Figure 8E:
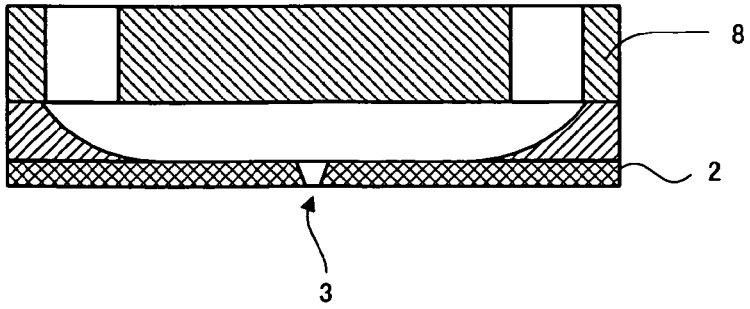
Figure 9:
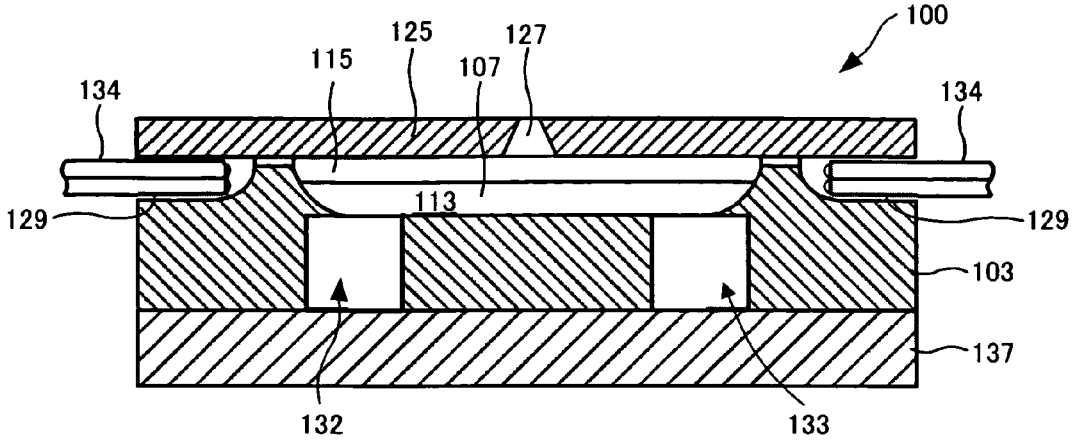
FIG. 9 is a schematic sectional view of a conventional well-known ink-jet head.

FIG. 8E illustrates a vertical sectional view of the incomplete liquid jet head after a nozzle-plate bonding step of bonding and joining the nozzle plate 2 onto the another surface 17 of the piezoelectric plate 4. The nozzle plate 2 is formed of a polyimide resin, the piezoelectric plate 4 is joined with an adhesive onto the another surface 17 of the piezoelectric plate 4. The nozzle 3 has a funnel shape including an opening cross-section area gradually decreasing from the elongated groove 5 side to the outside. A funnel shaped through-hole is formed with a laser beam. The nozzle 3 is provided in the center portion in the longitudinal direction of the elongated groove 5.

Note that, in addition to the steps illustrated in FIG. 8A to FIG. 8E, the manufacturing method for the liquid jet head 1 according to the present invention may include a channel-member bonding step of bonding and joining, onto the one surface of the cover plate 8, the prepared channel member including the liquid supply chamber and the liquid discharge chamber. The bonding is performed in such a manner that the liquid supply hole 9 and the liquid discharge hole 10 formed in the cover plate 8 are communicated to the liquid supply chamber and the liquid discharge chamber, respectively. With this, it is possible to evenly supply the liquid into the large number of the elongated grooves 5. At the same time, it is possible to cause the channel member to function as a damping chamber for suppressing pulsation of the liquid pumps from being transmitted to the nozzle 3 side.

Further, in the cutting process step, the elongated groove 5 is cut so that the tip of the shape having a convex shape in the depth direction of the elongated groove 5 is not opened to the outside, and thus the piezoelectric material is left on the tip in the depth direction. In a case where the piezoelectric material is left on the bottom surface side of the elongated groove 5, a through-hole is formed correspondingly to the nozzle 3 before or after the cutting process step. The formation of the through-hole is performed in such a manner that the side walls 6 defining the elongated groove 5 are not subjected to the cutting, and hence the side walls are not broken during the cutting. When the piezoelectric material is left on the bottom portion of the elongated groove 5, a distance between a region of the elongated groove 5 and a discharging port of the nozzle 3 is increased. Thus, the residence in the channel is increased and the discharge speed is decreased. Therefore, it is preferred that the bottom portion of the elongated groove 5 be opened, to thereby set the surface of the nozzle plate 2 to be the bottom side of the elongated groove 5.

According to the manufacturing method for the liquid jet head 1 of the present invention, it is possible to cause, without requiring the high accuracy cutting technology, the liquid supply hole 9 and the liquid discharge hole 10 to correspond or substantially correspond to the both-end opening portions of the elongated grooves 5. As a result, the liquid supply hole and the liquid discharge hole can be communicated to the both-end opening portions of the elongated grooves. Further, the liquid is supplied into the elongated grooves 5, each of which has the convex shape in the depth direction, from the surface side including the elongated grooves 5 formed therein, and the liquid is discharged from the same surface side. Therefore, it is possible to reduce the stagnation and the residence of the liquid in the inside of the elongated groove 5. Therefore, even if the foreign matters such as bubbles and the dust are entered and mixed into the elongated groove 5, the bubbles and the dust can be quickly discharged to outside, thereby being capable of reducing the clogging of the nozzles 3.

What is claimed is:

1. A liquid jet head, comprising:

a nozzle plate having a nozzle for ejecting a liquid onto a recording medium;

a piezoelectric plate having a first surface, an elongated groove formed in the first surface, and a second surface connected to the nozzle plate; and a cover plate having a liquid supply hole for supplying the liquid into the elongated groove of the piezoelectric plate, and having a liquid discharge hole for discharging the liquid through the elongated groove, the cover plate being disposed on the first surface of the piezoelectric plate;

wherein a cross-section of the elongated groove of the piezoelectric plate in a longitudinal direction and a depth direction of the elongated groove is a convex shape;

wherein the elongated groove is communicated, at a tip of the convex shape, to the nozzle; and wherein the elongated groove is communicated, in a bottom portion of the convex shape, to the liquid supply hole and the liquid discharge hole.

2. A liquid jet head according to claim 1, wherein the cross-section of the elongated groove has a circular-arc shape having a convex shape in the depth direction.

3. A liquid jet head according to claim 2, wherein the elongated groove is communicated, in at least one of opening end portions in the longitudinal direction of the elongated groove, to one of the liquid supply hole and the liquid discharge hole.

4. A liquid jet head according to claim 2, wherein the elongated groove comprises a plurality of elongated grooves; and wherein the liquid discharge hole discharges the liquid through the plurality of elongated grooves and the liquid supply hole supplies the liquid into the plurality of elongated grooves.

5. A liquid jet head according to claim 2, wherein the elongated groove comprises a plurality of elongated grooves; and wherein the nozzle plate comprises a plurality of nozzles communicated to respective ones of the elongated grooves.

6. A liquid jet head according to claim 2, further comprising a channel member disposed on the first surface of the piezoelectric plate, the channel member having a liquid supply chamber for holding the liquid to be supplied into the liquid supply hole, and having a liquid discharge chamber for holding the liquid discharged from the liquid discharge hole.

7. A liquid jet head according to claim 2, further comprising:

a driver circuit for supplying a driving power to an electrode formed on a side wall of the elongated groove;

a flexible printed circuit which comprises the driver circuit mounted thereon, and which is disposed on the piezoelectric plate; and a base body for receiving the piezoelectric plate and the cover plate under a state in which the nozzle plate is exposed to an outside of the liquid jet head and for fixing the flexible printed circuit on an outer surface of the base body.

8. A liquid jet head according to claim 1, wherein the elongated groove is communicated, in at least one of opening end portions in the longitudinal direction of the elongated groove, to one of the liquid supply hole and the liquid discharge hole.

9. A liquid jet head according to claim 1, wherein the elongated groove comprises a plurality of elongated grooves; and wherein the liquid discharge hole of the cover plate discharges the liquid through the plurality of elongated grooves and the liquid supply hole of the cover plate supplies the liquid into the plurality of elongated grooves.

10. A liquid jet head according to claim 1, wherein the elongated groove comprises a plurality of elongated grooves; and wherein the nozzle plate comprises a plurality of nozzles communicating with espective ones of the plurality of elongated grooves.

11. A liquid jet head according to claim 1, further comprising a channel member disposed on the first surface of the piezoelectric plate, the channel member having a liquid supply chamber for holding the liquid to be supplied into the liquid supply hole, and having a liquid discharge chamber for holding the liquid discharged from the liquid discharge hole.

12. A liquid jet head according to claim 1, further comprising:

a driver circuit for supplying a driving power to an electrode formed on a side wall of the elongated groove;

a flexible printed circuit which comprises the driver circuit mounted thereon, and which is disposed on the piezoelectric plate; and a base body for receiving the piezoelectric plate and the cover plate under a state in which the nozzle plate is exposed to an outside of the liquid jet head and for fixing the flexible printed circuit on an outer surface of the base body.

13. A liquid jet apparatus, comprising:

the liquid jet head according to claim 1;

a liquid tank for supplying a liquid into the liquid supply hole of the cover plate of the liquid jet head and for reserving the liquid discharged from the liquid discharge hole of the cover plate;

a press pump for pressing and supplying the liquid from the liquid tank into the liquid supply hole of the cover plate; and a suction pump for sucking and discharging the liquid from the liquid discharge hole of the cover plate into the liquid tank.

14. A liquid jet apparatus according to claim 13, further comprising, in a path between the liquid discharge hole of the cover plate and the liquid tank, a deaeration unit having a deaeration function.

15. A liquid jet apparatus comprising:

a nozzle plate having at least one nozzle for ejecting a liquid onto a recording medium;

a cover plate having a liquid supply hole for supplying the liquid and a liquid discharge hole for discharging the liquid; and a piezoelectric plate having at least one elongated groove, the piezoelectric plate, cover plate and nozzle plate being stacked relative one another with the at least one elongated groove communicating with the at least one nozzle of the nozzle plate and with each of the liquid supply hole and the liquid discharge hole of the cover plate so that liquid supplied into the at least one elongated groove through the liquid supply hole circulates through the at least one elongated groove and is discharged from the liquid discharge hole.

16. A liquid jet apparatus according to claim 15; wherein a cross-section of the at least one elongated groove of the piezoelectric plate in a longitudinal direction and a depth direction of the at least one elongated groove has a convex shape; wherein the at least one elongated groove communicates with the nozzle of the nozzle plate at a tip of the convex shape; and wherein the at least one elongated groove communicates with the liquid supply hole and the liquid discharge hole of the cover plate at a bottom portion of the convex shape.

17. A liquid jet apparatus according to claim 15; wherein the at least one nozzle of the nozzle plate comprises a plurality of nozzles; and wherein the at least one elongated groove of the piezoelectric plate comprises a plurality of elongated grooves communicating with respective ones of the plurality of nozzles.

18. A liquid jet head according to claim 15, further comprising:

a driver circuit for supplying a driving power to an electrode formed on a side wall of the at least one elongated groove;

a flexible printed circuit which comprises the driver circuit mounted thereon, and which is disposed on the piezoelectric plate; and a base body for receiving the piezoelectric plate and the cover plate under a state in which the nozzle plate is exposed to an outside of the liquid jet head and for fixing the flexible printed circuit on an outer surface of the base body.

19. A liquid jet apparatus, comprising:

the liquid jet head according to claim 15;

a liquid tank for supplying a liquid into the liquid supply hole of the cover plate of the liquid jet head and for storing the liquid discharged from the liquid discharge hole of the cover plate;

a press pump for pressing and supplying the liquid from the liquid tank into the liquid supply hole of the cover plate; and a suction pump for sucking and discharging the liquid from the liquid discharge hole of the cover plate into the liquid tank.

20. A liquid jet apparatus according to claim 19, further comprising, in a path between the liquid discharge hole of the cover plate and the liquid tank, a deaeration unit having a deaeration function for reducing a content of gas contained in the liquid.

* * * * *